US005090915A

United States Patent [19]

Moulton

[11] Patent Number: 5,090,915

[45] Date of Patent: Feb. 25, 1992

[54] SELF-TERMINATING COAXIAL TAP CONNECTOR WITH EXTERNAL TERMINATION ELEMENT

[75] Inventor: James I. Moulton, Sunnyvale, Calif.

[73] Assignee: Apple Computer, Inc., Cupertino, Calif.

[21] Appl. No.: 596,128

[22] Filed: Oct. 11, 1990

[51] Int. Cl.[5] ..... H01R 29/00

[52] U.S. Cl. ..... 439/188; 200/51.1

[58] Field of Search ..... 439/188, 578-585, 439/620, 675, 63; 200/51.1, 51.09, 51 R

[56] References Cited

U.S. PATENT DOCUMENTS

| | | | |
|---|---|---|---|
| 3,459,906 | 8/1969 | O'Keefe et al. | 200/51.1 |
| 4,575,694 | 3/1986 | Lapke et al. | 200/51.1 X |
| 4,588,249 | 5/1986 | Blichasz et al. | 439/583 X |
| 4,759,729 | 7/1988 | Kemppainen | 439/581 X |
| 4,804,339 | 2/1989 | Cohen | 439/588 |
| 4,825,021 | 4/1989 | Pauza | 200/51.1 X |
| 4,971,569 | 11/1990 | Gooch et al. | 439/581 X |

*Primary Examiner*—Neil Abrams
*Assistant Examiner*—Khiem Nguyen
*Attorney, Agent, or Firm*—Mark Aaker

[57] ABSTRACT

A self-terminating coaxial tap connector for use with an external termination element has two oppositely directed coaxial connector sockets having conncected center conductors and connected surround shields, the connected shields having a mounting tab for attachment to a printed circuit board. Within the connected shields is a secondary conductor parallel and spaced from the center conductors. Within each socket, at an end of the secondary conductor near the end of a center conductor, is a movable switch element connected to the secondary conductor and having a first switch position in contact with the center conductor when the socket is open, and having a second switch position detached from the center conductor when a mating plug connector is coupled to the socket, the switch element being moved to the second switch position by abutment with the mating plug connector. The tap connection is provided by a center conductor contact pin running from the connected center conductors and extending through and ending external of the connected shields for attachment to a printed circuit board. A secondary conductor contact pin runs from the secondary conductor and extends through and ends external of the shields for attachment to a printed circuit board. A termination circuit element is mounted on the printed circuit board and connected from the secondary conductor contact pin to the shield mounting tab.

11 Claims, 1 Drawing Sheet

SELF-TERMINATING COAXIAL TAP CONNECTOR WITH EXTERNAL TERMINATION ELEMENT

BACKGROUND OF THE INVENTION

This invention relates to electrical connectors, particularly to a self-terminating coaxial tap connector for use with an external termination element.

Coaxial cables and connectors typically have a center conductor insulated from and surrounded by a shield. Coaxial cables and connectors are often used for high frequency electrical signals, since the coaxial design provides a more uniform electrical impedance, and the surrounding shield prevents electrical signals from radiating into or out of the inner conductor. Coaxial connectors, when coupled, are designed to maintain these characteristics of uniform impedance and shielding of the center conductor.

A coaxial "tap" connector is connected between two coaxial cables in order to "branch" or "tap" the signal in an additional third direction. A tap connector is often used to add an additional device to a coaxial bus or local-area-network running between several devices. A coaxial "tap" connector has two coaxial connector ports having connected shields and connected center conductors, with a "tap" or "T" connection to the connected center conductors for carrying the signals in yet a third direction. Commonly, the tap connection crosses through and ends outside of the connected shields for connection to a printed circuit board.

When a coaxial connector on a cable or on a coaxial tap connector is left "open" or unconnected, the uniform impedance characteristics are disturbed, and undesirable reflection of signals and radiation of electrical signals into and out of the center connector can occur. A "self-terminating" coaxial connector reduces these problems by automatically switching to a "terminated" condition when the coaxial connector is left open or uncoupled. A terminated condition exists when the center conductor is connected to the shield through a termination circuit element having the same characteristic impedance as the coaxial connector and cable.

One type of self-terminating coaxial connector is shown in U.S. Pat. No. 4,575,694 to Lapke et al. Lapke et al shows a connector to be used on the end of a coaxial cable which switches to a terminated condition when the connector is uncoupled or disconnected from a compatible (matching) connector. Lapke et al discloses a sliding dielectric sleeve disposed in the connector shell for movement between a first position and a second position which moves a switch element to include or exclude a termination circuit element. The sliding dielectric sleeve is biased by a coil spring in the shell behind the sleeve, and movement of the sleeve is driven by abutment with the face of a compatible connector during the coupling of two compatible connectors. Unfortunately, the design of Lapke et al leaves a substantial portion of the center conductor extending beyond the point of connection to the termination element inside the connector. This extension can cause both the reflection and signal radiation problems earlier described. Also, the design of Lapke et al requires a large number of moving mechanical elements to be assembled within the connector body, greatly increasing the cost and reducing the reliability of the connector.

A second type of self-terminating coaxial connector is shown in co-pending U.S. patent application Ser. No. 07/369,382, filed 06/21/89 and entitled SELF-TERMINATING COAXIAL TAP CONNECTOR (as amended) on which the present applicant is a co-inventor. In a first embodiment, this invention shows a self-terminating coaxial connector port which uses a sliding dielectric element to move a switch contact away from the center conductor. A second embodiment, without a sliding dielectric element, uses abutment with the mating connector to move a switch contact away from a contact land which runs through a termination circuit element to the center conductor. However, these designs also suffer from the presence of a extension or connection to the center conductor beyond the point of termination which can cause the reflection and signal radiation problems earlier described. Also, the designs require a number of mechanical elements to be assembled within the connector body, greatly increasing the cost and reducing the reliability of the connector.

SUMMARY OF THE INVENTION

This invention provides a self-terminating coaxial tap connector for use with an external termination element. The self-terminating coaxial tap connector is designed for printed circuit board mounting. A connector in accordance with this invention is self-terminating, has reduced signal reflection and signal radiation problems, has a simplified mechanical assembly within the connector, and locates the termination circuit element outside of the the connector body for reduced cost and increased reliability.

A self-terminating coaxial tap connector for printed circuit board mounting in accordance with this invention has two oppositely directed coaxial connector sockets having connected center conductors and connected surrounding shields, the connected shields having a mounting tab for attachment to a printed circuit board.

Within the connected shields is a secondary conductor parallel and spaced from the center conductors. Within each socket, at an end of the secondary conductor near the end of a center conductor, is a movable switch element connected to the secondary conductor and having a first switch position in contact with the center conductor when the socket is open, and having a second switch position detached from the center conductor when a mating plug connector is coupled to the socket, the switch element being moved to the second switch position by abutment with the mating plug connector.

The tap connection is provided by a center conductor contact pin running from the connected center conductors and extending through and ending external of the connected shields for attachment to a printed circuit board. A secondary conductor contact pin runs from the secondary conductor and extends through and ends external of the shields for attachment to a printed circuit board. A termination circuit element is mounted on the printed circuit board and connected from the secondary conductor contact pin to the shield mounting tab.

In operation, in an uncoupled socket, the movable switch element connects from the center conductor to the secondary conductor, from the secondary conductor through the secondary conductor contact pin to the printed circuit board, and through the termination circuit element mounted on the printed circuit board to the shield. When a mating plug is coupled to the socket, the movable switch element is moved out of contact with the center conductor, breaking the termination.

DETAILED DESCRIPTION

Figure 1:
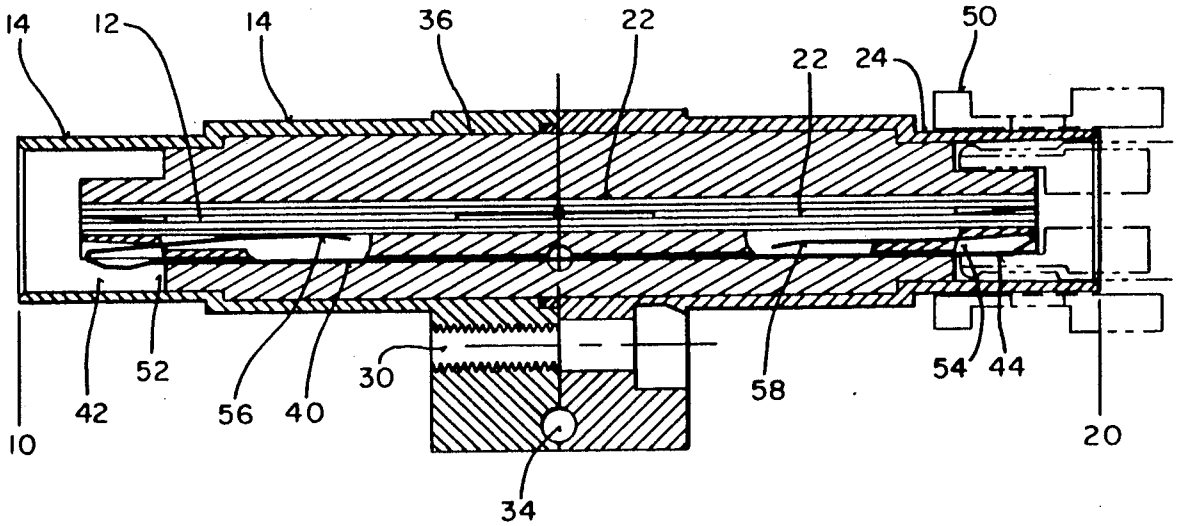
FIG. 1 is a cut-away side view of the internal features of a self-terminating coaxial tap connector in accordance with this invention.

FIG. 1 is a cut-away side view of the internal features of a self-terminating coaxial tap connector in accordance with this invention. The embodiment shown in FIG. 1 is for use with an external termination element and for mounting on a printed circuit board. The self-terminating coaxial tap connector has first and second coaxial connector sockets 10, 20 with first and second connected center conductors 12, 22 and first and second connected surrounding shields 14, 24. First coaxial connector socket 10 is shown open or uncoupled. Second coaxial connector socket 20 is shown coupled to a mating male plug 50. In a preferred embodiment shown in FIG. 1, these sockets can be of a BNC style, and can be manufactured according to known methods from standard materials. The connectors can be held together by a threaded fastener 30 between the first and second sockets 10,20.

A secondary conductor 40 is mounted within the connected shields 14, 24, and can be held in position by filling portions of the internal spaces with an insulator 36. Secondary conductor 40 is parallel to and spaced from the connected center conductors 12, 22 and has first and second ends 42, 44 terminating near each of first and second ends of the center conductors 12, 22. Each of the first and second secondary conductor ends 42, 44 are formed as a movable switch element having a first switch position in contact with its nearby center conductor, and a second position detached from its nearby center conductor. For example, when the socket is open, as shown at first socket 10, the movable switch contact on the end of first secondary conductor end 42 is in contact with the center conductor 12 at contact point 56. When the socket is coupled, as shown at second socket 20 and mating male plug 50, the movable switch contact on the end of second secondary conductor end 44 is detached from the center conductor 22 as shown at detached contact 58. The switch element is detached by abutment of the second secondary conductor end 44 with the mating plug connector 50.

The movable switch elements on first and second secondary conductor ends 42, 44 can be formed as C shaped spring metal shapes which are compressible. For example, at socket 10, with the open side of the C shape facing into the socket 10, and the first arm of the C shape connected to the first secondary conductor end 42, and the second arm of the C shape being movable and having a first switch position in contact with the first center conductor 12 when the socket is open. For further example, at socket 20, when a mating plug 50 is coupled to the socket 20, the C shaped second secondary conductor end 44 moves to a second switch position detached from the center conductor 22, the switch element being moved to the second switch position by compression and narrowing of the C shape by abutment of the side of the C shape with the mating plug connector 50.

In a further embodiment, as shown in FIG. 1, the secondary conductor ends 42, 44 can pivot on insulating pivot points 52, 54 between the spring contact and the center conductor, to further control and align the movement of the switch elements. For example, at socket 20, under abutment and compression from the mating plug 50, the second secondary conductor end 44 pivots on insulated pivot points 54 to move the second arm of the C shaped spring contact away from contact with the second center conductor 2.

Figure 2:
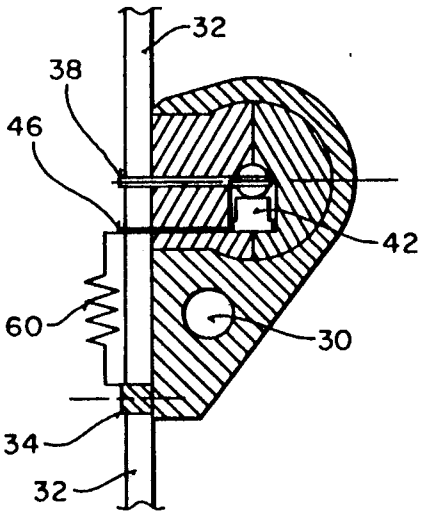
FIG. 2 is a cut-away end view of the self-terminating coaxial tap connector of FIG. 1.

FIG. 2 is a cut-away end view of the self-terminating coaxial tap connector of FIG. 1. The connected shields 14, 24 can be attached to the printed circuit board 32 by a mounting tab 34. In an alternative form, the portions of the sockets joined by the threaded fastener 30 are located around the circumference of the sockets away from the tabs for mounting to a printed circuit board 32, this allows clearance for components to be mounted on the printed circuit board 32 closer to the connector.

A center conductor contact pin 38 connects to the connected center conductors 12, 22 and extends through and insulated from the connected shields 14, 24 to end external to the connected shields 14, 24 for connection to a printed circuit board 32.

A secondary conductor contact pin 46 connects to the secondary conductor 40 and extends through and insulated from the connected shields 14, 24 to end external to the connected shields 14, 24 for connection to the printed circuit board 32. To provide termination, a termination circuit element 60 is mounted on the printed circuit board 32 and connected from the secondary conductor contact pin 46 to the connected shields mounting tab 34. In a preferred form, the termination circuit element 60 is a 50 ohm resistor.

The length of the connectors can be substantially shortened from that shown in FIG. 1, and it should be noted that since the secondary conductor ends 42, 44 can be quite close to the ends of the connected center conductors 12, 22, there is very little extension of the center conductor beyond the point of termination, which provides reduced signal reflection and signal radiation problems as compared with the prior art. It should also be noted that only secondary conductor 40 has any moving parts, which can be spring-formed and do not require any mechanical assembly. Therefore the entire connector has simplified assembly requirements and lower cost as compared to the prior art. This design also locates the termination circuit element outside of the connector body for reduced assembly cost and increased reliability.

Where the mating plug connector has self-terminating switch contact elements within it, it is important that interference between the plug and switch contacts be avoided to allow proper operation of each. This can be accomplished by positioning the secondary conductor ends 42, 44 at particular angular orientations in the BNC style socket. Then, by limiting the rotation angle allowed of the BNC style plug, interference between switch elements in the plug and switch elements in the socket can be avoided.

In an alternative connector embodiment, the secondary conductor 40 can be broken into two sections, corresponding to the first end 52 and second end 54. Each end can be provided with its own contact pin 46 extending external of the shield 14, 24, and each can then have its own termination circuit element 60.

In a second alternative connector embodiment, the self-terminating tap and termination circuit element can be packaged within a single "barrel" configuration to serve as a self-terminating coaxial barrel connector for joining two segments of coaxial cable.

These and other embodiments of the invention can be practiced without departing from the true scope and spirit of the invention, which is defined by the following claims.

I claim:

1. A self-terminating coaxial tap connector with external termination circuit for mounting on a printed circuit board comprising:

first and second coaxial connector sockets with first and second connected center conductors and first and second connected surrounding shields;

a mounting tab on said connected shields for attachment to said printed circuit board;

a center conductor contact pin connected to said connected center conductors and extending through and insulated from said connected shields to end external to said connected shields for connection to said printed circuit board;

a secondary conductor within said connected shields parallel to and spaced from said connected center conductors and having first and second ends terminating near each of first and second ends of said center conductors, each of said first and second secondary conductor ends being formed as a movable switch element having a first switch position in contact with said center conductor when said socket is open, and having a second switch position detached from said center conductor when a mating plug connector is coupled to said socket, said switch element being moved to said second switch position by abutment with said mating plug connector; and a secondary conductor contact pin connected to said secondary conductor and extending through and insulated from said connected shields to end external to said connected shields for connection to said printed circuit board.

2. A self-terminating coaxial connector as in claim 1 further comprising a termination circuit element mounted on said printed circuit board and connecting from said secondary conductor contact pin to said mounting tab of said shield.

3. A self-terminating coaxial tap connector as in claim 1 wherein said coaxial connector socket and said mating plug connector are of a BNC style.

4. A self-terminating coaxial tap connector as in claim 1 wherein said movable switch element is a compressible C shaped spring contact having a first arm, a second arm and an open side of said C shape, with said open side of said C shape facing into said socket, and said first arm of said C shape connected to said secondary conductor, and said second arm of said C shape being movable and having a first switch position in contact with said center conductor when said socket is open, and having a second switch position detached from said center conductor when a mating plug connector is coupled to said socket, said switch element being moved to said second switch position by compression and narrowing of said C shape by abutment of said a side of said C shape with said mating plug connector.

5. A self-terminating coaxial tap connector as in claim 4 wherein said C shape spring contact pivots on an insulated pivot point between said spring contact and said center conductor, wherein said compression from a said mating plug pivots said C shaped spring contact away from contact with said center conductor.

6. A self-terminating coaxial tap connector for printed circuit board mounting comprising:

first and second coaxial connector sockets, with first and second connected center conductors and first and second connected surrounding shields, each said socket having a first open end for receiving a mating plug connector, and a second closed end for mounting back-to-back with other said socket;

said first and second connected surrounding shields having a mounting tab for attachment to a printed circuit board;

said first center conductor having first and second ends, said first end toward said first open end of said first socket and having a receptacle tip for receiving the tip of a center conductor of a said mating plug connector, and second end of said center conductor being connected to said second center conductor of said second socket;

a secondary conductor parallel to said first center conductor but spaced from said first center conductor within said first and second connected surrounding shields, said secondary conductor having first and second ends closest to corresponding first and second ends of said first center conductor;

a compressible C shape spring contact having an open side of said C shape facing into said first socket, and having a first arm of said C shape connected to said first end of said secondary conductor, and having a second arm of said C shape movably contacting to said first center conductor at a contact point near but behind the receptacle tip of said first center conductor, said C shape spring contact being located to receive compression from a said mating plug connector so as to narrow said C shape spring contact and remove said second arm from contact to said contact point on said first center conductor;

a center conductor contact pin connected to said first and second connected center conductors and extending through and insulated from said first and second connected surrounding shields to end external to said first and second connected surrounding shields for connection to said printed circuit board; and a secondary conductor contact pin connected to said secondary conductor and extending through and insulated from said first and second connected surrounding shields to end external to said first and second connected surrounding shields for connection to said printed circuit board.

7. A self-terminating coaxial connector as in claim 6 further comprising a termination circuit element mounted on said printed circuit board and connecting from said secondary conductor contact pin to said mounting tab of said first and second connected surrounding shields.

8. A self-terminating coaxial connector as in claim 6 wherein said socket and said receptacle tip of said first center conductor are of a BNC style.

9. A self-terminating coaxial connector as in claim 6 wherein said second arm of said C shaped spring contact rests on an insulated pivot point between it and said first center conductor, wherein said compression from a said mating plug pivots said second arm away from contact with said contact point on said first center conductor.

10. A self-terminating coaxial connector as in claim 6 wherein said secondary conductor is electrically separated into said first and second ends, and each said end having a said secondary conductor contact pin extending through and insulated from said first and second connected surrounding shields to end external to said first and second connected surrounding shields for connection to said printed circuit board.

11. A self-terminating coaxial connector as in claim 6 further comprising a termination circuit element mounted on said printed circuit board and connecting from said secondary conductor contact pin to said mounting tab of said said first and second connected surrounding shields.

* * * * *